US006450334B1

(12) United States Patent
Chang

(10) Patent No.: US 6,450,334 B1
(45) Date of Patent: Sep. 17, 2002

(54) GOLF BAG AND METHOD FOR MANUFACTURING SAME

(75) Inventor: I-Teh Chang, Kowloon (HK)

(73) Assignee: Mortex Limited, Kowloon (HK)

( * ) Notice: Subject to any disclaimer, the term of this patent is extended or adjusted under 35 U.S.C. 154(b) by 0 days.

(21) Appl. No.: 09/765,289

(22) Filed: Jan. 22, 2001

(51) Int. Cl.[7] ..... A63B 55/00; A63B 55/04

(52) U.S. Cl. ..... 206/315.3; 206/315.7; 206/315.6; 248/96; 211/70.2

(58) Field of Search ..... 206/315.3, 315.4, 206/315.5, 315.6, 315.7, 315.8; 211/70.2; 248/96

(56) References Cited

U.S. PATENT DOCUMENTS

| | | | | | |
|---|---|---|---|---|---|
| 1,715,668 | A | * | 6/1929 | Mooney | 248/96 X |
| 5,178,273 | A | * | 1/1993 | Igarashi | 206/315.7 |
| 5,356,003 | A | * | 10/1994 | Gretz et al. | 206/315.7 |
| 5,390,788 | A | | 2/1995 | Schenkkan | |
| 5,501,328 | A | * | 3/1996 | Keller et al. | 206/315.6 |
| 5,638,954 | A | * | 6/1997 | Hsien | 206/315.8 |
| 5,725,095 | A | * | 3/1998 | Beck et al. | 206/315.8 |
| 6,062,383 | A | | 5/2000 | Han | |

* cited by examiner

*Primary Examiner*—Lee Young
*Assistant Examiner*—Tri M. Mai
(74) *Attorney, Agent, or Firm*—Burns, Doane, Swecker & Mathis, L.L.P.

(57) ABSTRACT

A golf bag with a built-in assembly included a top moulded member wherein the moulded top member includes a neck portion, a collar portion and a shoulder portion connecting the neck and collar portions, the neck portion includes a longitudinally extending circumferential wall which defines the inner aperture of the top member and a longitudinal part which is surrounded by the enclosure, the collar portion includes a circumferential wall surrounding the neck portion and appendages which are laterally spaced apart for receiving a part of the stand assembly for connection to the top moulded member.

17 Claims, 12 Drawing Sheets

GOLF BAG AND METHOD FOR MANUFACTURING SAME

FIELD OF THE INVENTION

The present invention relates to a golf bag and, more particularly to a golf bag with a stand assembly for supporting a golf bag to stand at an inclination to the vertical. This invention also relates to a top moulded member of a golf bag with a stand assembly and method for making same.

BACKGROUND OF THE INVENTION

Golf is a popular outdoor game with ever increasing popularity in many places around the world. A typical golf game is played on a course of 9, 18 or even 36 holes in which a golfer moves sequentially from one hole to another until all the holes have been attended. The distances between the holes can vary in length from about a hundred meters to several hundred meters. Some of the holes are flanked by rough areas which make it more difficult to play.

In a golf game a golfer must use a golf club to strike a golf ball towards the target hole. Different clubs have different technical characteristics and are used for different situations. Typically, a golfer is allowed to carry up to 14 pieces of golf clubs in a golf bag. In order to strike a golf ball for a relatively long distance, a golfer has to make a big body swing or twist to impart more power to the ball for a long flight. After the hits, the golfer will move on to the landing position of the ball and prepare for the next strike. In moving between holes, many golfers prefer to carry the fully loaded golf bag by himself or herself to increase the exercise level of a golf game. Many expensive and good quality golf bags are provided with a stand assembly so that the golf bag can rest on its own in a nearly vertical position with its top opening facing the sky when a golfer is preparing for the next hit. A full set of golf equipment, including golf balls, clubs and other accessories, may weigh up to 10–kg. As the game involves considerably bodily movements covering up to several kilometers, a golfer may become tired and it is well known that many golfers habitually, but somehow unconsciously, lean and rest their body weight against an upstanding golf bag in order to obtain some rest in between movements following the golf ball.

Golf bags with a built-in stand assembly are widely used because the stand assembly can provide a stable support to maintain the golf bag in an upright position while the golfer is preparing for the next strike. A typical stand for a golf bag usually includes a pair of retractable inverted V-shape legs which are attached to the rigid top collar of the golf bag and the angular width of which increases as the free ends move away from the bag. The stand assembly is usually attached to the top end of a golf bag by rivets and is typically designed and tested to withstand the maximum likely weight of a fully loaded golf bag which may be in the region of 15–25 kg. In order to share the weight equally between the legs of the stand assembly, the legs are always laterally symmetrical about the longitudinal axis of the tubular golf bag. This symmetry is desirable because otherwise the weight of a person leaning against the golf bag may produce undesirable torsion at the joints connecting the stand assembly and the golf bag. Such undesirable torsion may cause the legs to twist about the joint and result in undesirably distortion of the joint which further aggravates the non-symmetry about the axis of the bag. The non-symmetry when coupled with further and undesirable torsion at the joints may result in breakage of the joints and cause severe personal injuries. The leg symmetry is usually obtained and maintained by riveting a stand assembly to both the top and bottom parts of the golf bag with careful alignment procedures in order to ensure lateral symmetry.

As non-symmetry of the legs may lead to personal injuries, an accurate and careful manufacturing and testing process is essential and this would inevitably increase the production costs and the lead-time for delivery. Furthermore, as a golf bag is constantly subject to weathering due to the outdoor nature of the game, the rivets may deteriorate and weaken after prolonged weathering. The joints with weakened rivets are more prone to breakage and may lead to personal injuries if a golfer habitually and improperly leans his or her weight against the supported golf bag. Hence, it would be desirable if a golf bag with strong top brackets for securing the stand assembly can be provided. Preferably, such a golf bag should be easily assembled without the need of tedious and precise alignment procedures.

A conventional golf bag includes a moulded top collar member, a moulded bottom member, a supporting structure extending between the top and bottom moulded members and an enclosure. The supporting structure usually comprises a plurality of rigid and strong stays which are usually thin metal posts. Golf clubs are usually placed within the golf bag with the handles resting on the bottom member, the shafts resting against the edges hard-plastic moulded top member and the heads exposing above the bag. It is well-known that the hard plastic edges on the top collar is unfriendly to graphite shafts. Many good golf clubs come with a graphite shaft. When a golfer carries a golf bag from one position to another, the golf clubs jolt and bounce within the golf bag with their shafts agitating against the inner edges of the hard plastic top moulded member which can be very damaging to the expensive golf clubs. To alleviate such likely shaft damages, a cushioning member which is friendly to graphite shafts is usually wrapped around the top collar member to protect the shafts.

However, as a stand assembly is usually pivotally attached to the top mould member of the golf bag which is usually the only suitable part of the golf bag which is solid enough to receive the stand assembly, a part of the cushioning material proximate to the pivoted joints has to be removed or left as a flap to allow pivotal movement of the stand assembly to and from the golf bag. The exposure of the bare top member with the metallic rivets or the overhanging flap member is somewhat unsightly and noncompatible with an otherwise well designed and expensive golf bag and is therefore undesirable. Hence, it would be desirable if a golf bag with a built-in stand assembly and a cushioned top member can be provided without either a flap member or the removal of a portion of the cushioning member proximate to the stand assembly junction.

It is therefore an object of the present invention to provide a golf bag with a built-in stand assembly in which the stand assembly can be easily and robustly attached to the golf bag without a tedious alignment process and with a joint that is not immediately exposed to a user in his normal position. It is a further object of the present invention to provide a cushioned top moulded member of a golf bag in which there is no need to provide remove a portion of the cushion member expose the joint or to allow for a flap member proximate to the joint between the stand assembly and the golf bag to allow for pivotal expansion of the stand assembly. It is a further object of the present invention to at least provide a useful choice of a golf bag and a top member of a golf bag to the general public.

SUMMARY OF THE INVENTION

According to a first aspect of the present invention, there is provided a moulded top member of a golf bag which bag includes the top moulded member, a moulded bottom member, a supporting structure connecting said top member and said bottom moulded member, an enclosure extending between the top and bottom members and enclosing said supporting structure and a stand assembly, wherein said moulded top member includes a neck portion, a collar portion and a shoulder portion connecting said neck and collar portions, said neck portion includes a longitudinally extending circumferential wall which defines the inner aperture of said top member and a longitudinal part of which is surrounded by said enclosure, said collar portion includes a circumferential wall surrounding said neck portion, wherein a top bracket for securing said stand assembly to said golf bag is formed between said collar portion and said neck portion, and a cushioning member having a first and a second end is secured on said top member, said first end is secured on said collar portion, said second end is secured on said neck portion and the portion of the cushioning member between said first and second ends covers said shoulder portion.

Preferably, a moulded member means for releasably securing said cushioning member is formed on the underside of said moulded member.

Preferably, one end of said cushioning member includes a semi-rigid portion.

Preferably, the means for securing said cushioning member includes a channel formed between said neck and collar portion.

Preferably, a bracket for receiving said stand assembly is integrally moulded on said top member between the circumferential walls of said neck and collar portions.

Preferably, the second end of said cushioning member is secured onto the outside of the circumferential wall of said neck portion which is not surrounded by said collar portion.

According to a second aspect of the present invention, there is provided a moulded top member of a golf bag which includes the top moulded member, a closed moulded bottom member, a supporting structure connecting said top and bottom moulded members, an enclosure extending between the top and bottom members and enclosing said supporting structure and a stand assembly, wherein said moulded top member includes a neck portion and a collar portion, said neck portion includes a longitudinally extending circumferential wall which defines the inner aperture of said top member and a longitudinal part of which is surrounded by said enclosure, said collar portion includes a circumferential wall surrounding said neck portion, wherein means for attaching said stand assembly to said golf bag is formed between said collar portion and said neck portion, and means for releasably securing one end of a cushion member for alleviating agitation of golf clubs against said moulded top member during use of the golf bag is provided on the underside of said top moulded member.

BRIEF DESCRIPTION OF THE DRAWINGS

Preferred embodiments of the present invention will now be explained in greater details by way of examples and with reference to the accompanying drawings, in which:

FIG. 15*b* is a cross sectional view of the cushioning member of FIG. 15*a* taken at lines 15—15 of FIG. 15=a.

DETAILED DESCRIPTION OF THE PREFERRED EMBODIMENTS

Figure 1:
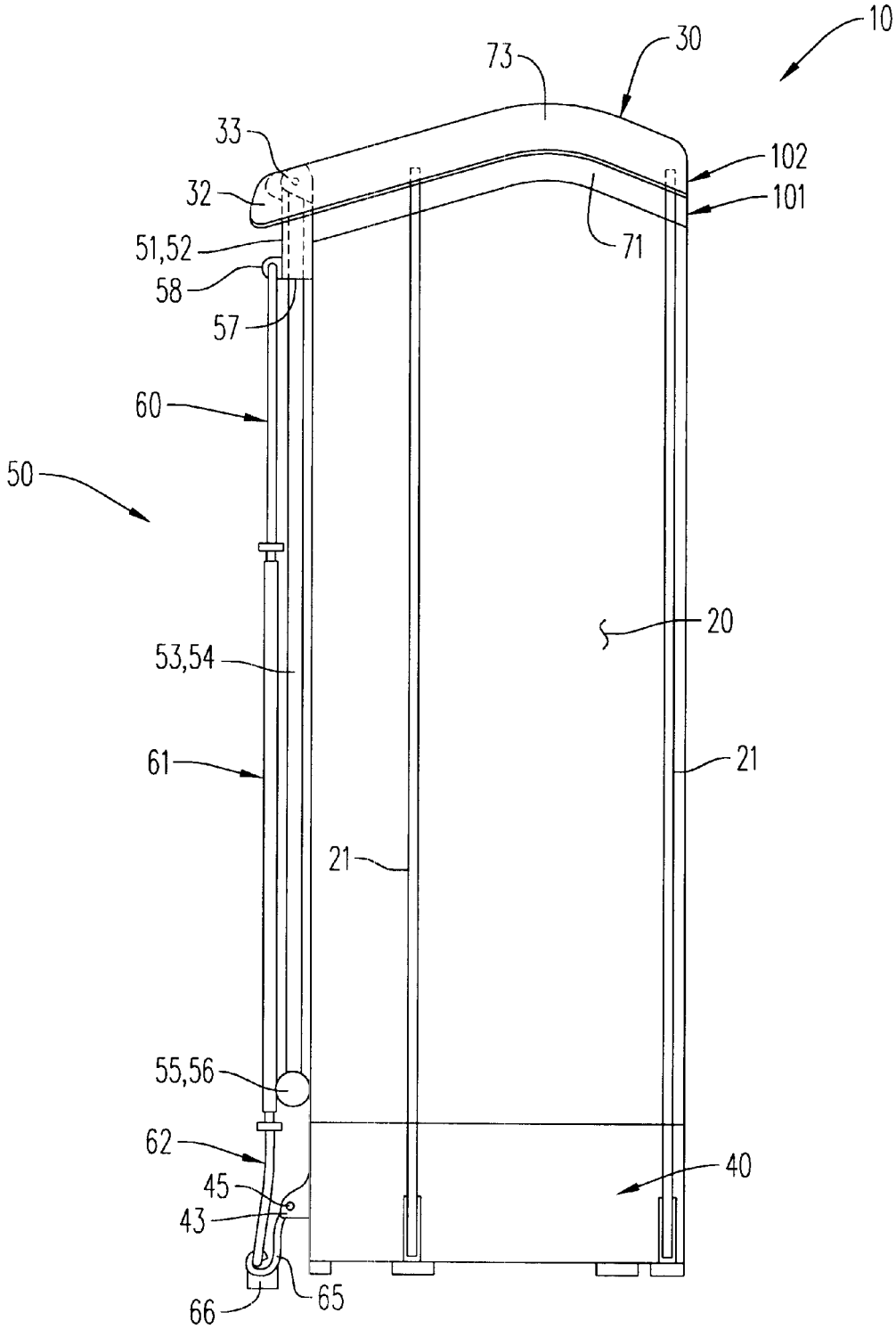
FIG. 1 is a side view of a golf bag of the present invention in which the stand assembly is fully retracted to one side of the golf bag.
Figure 2:
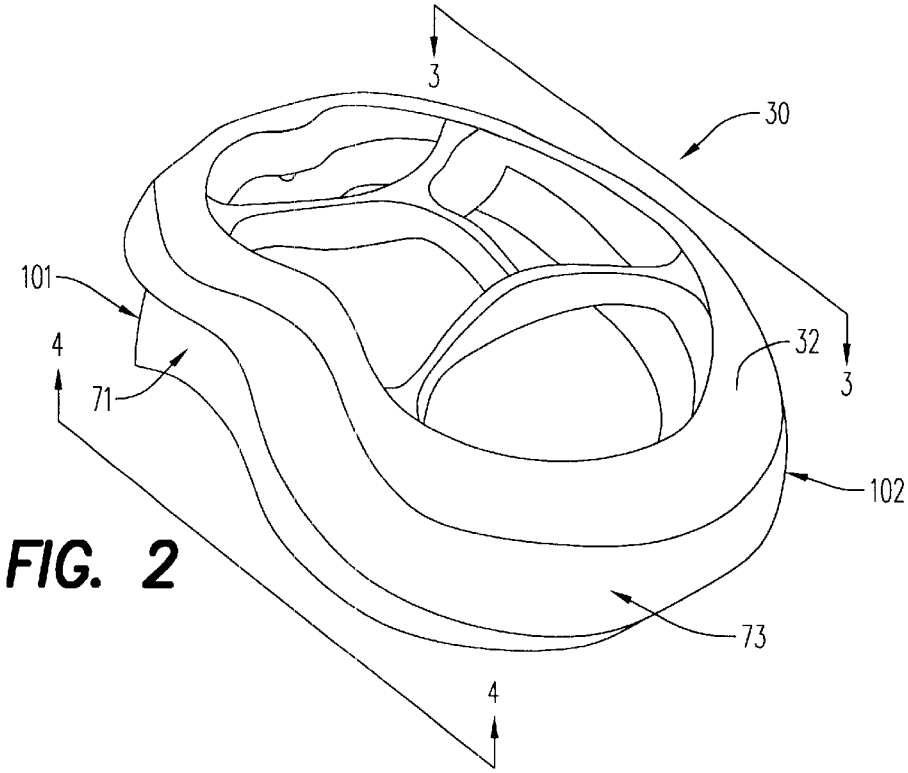
FIG. 2 is a top perspective view of the top moulded member of the golf bag of FIG. 1.
Figure 3:
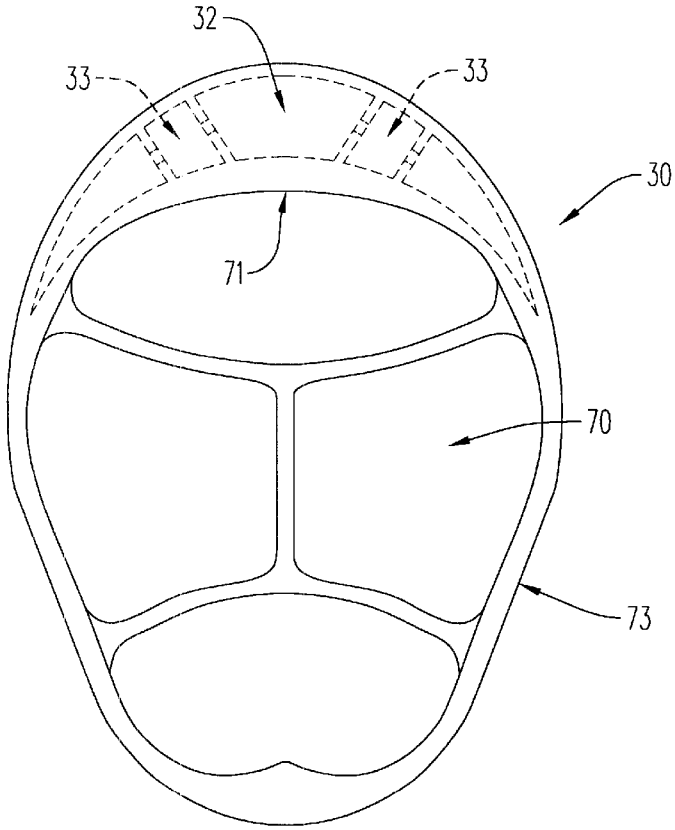
FIG. 3 is a top view of the top moulded member of FIG. 2.

Referring to FIGS. 1–9 in which there is shown a preferred embodiment of a golf bag of the present invention, the golf bag 10 generally includes a tubular body 20, a top moulded member 30, a bottom moulded member 40, a stand assembly 50 and a supporting structure connecting the top and bottom moulded member. The top moulded member is a substantially tubular member moulded preferably of hard plastic which includes a neck and a collar portion.

The neck portion 101 includes a longitudinally extending circumferential wall 71 which defines the inner aperture 72 of the top moulded member 30 and also the top opening of the golf bag through which golf clubs are inserted or removed. The collar portion 102 includes another substantially longitudinally extending circumferential wall 73 which surrounds a longitudinal part of the neck portion 101. The neck and collar portions 101, 102 are joined together by a rounded shoulder portion 32. Brackets 33 for securing the stand assembly 50 onto the golf bag 10 are formed on the top moulded member 30 because the part of a golf bag between the top and bottom moulded members usually only comprises a thin supporting structure enclosed by a flexible enclosure which is not strong enough to support the stand assembly.

In the present embodiment, the top brackets 33 are formed underneath the rounded shoulder portion 32 and in the space between the circumferential walls 71, 73 of the neck and collar portions 101, 102 which are provided specifically for the brackets 33 so that the actual joints are substantially concealed for aesthetic considerations as well as for shielding from direct weathering. The brackets 33 are preferably integrally moulded with the top moulded member 30 to provide for extra strength and robustness to withstand the weight of a leaning golfer.

In the present preferred embodiment, each of the brackets 33 includes a pair of parallel socket walls which are integrally moulded to the circumferential walls of the collar and neck portion and the underside of the shoulder portion which joins the two circumferential walls. Unlike a bracket used in a conventional golf bag in which the bracket is only attached to outside surface of the top member, each of the top brackets 33 in the present embodiment is integrally moulded to the two strong circumferential walls 71, 73 of the top moulded member 30, giving the bracket 33 an overall strength which is similar to that of the top moulded member 30. Furthermore, to separate different types of golf clubs stored within the golf bag, a partitioning structure which divides the top opening into a plurality of areas is also preferably integrally moulded on the top moulded member.

Figure 6:
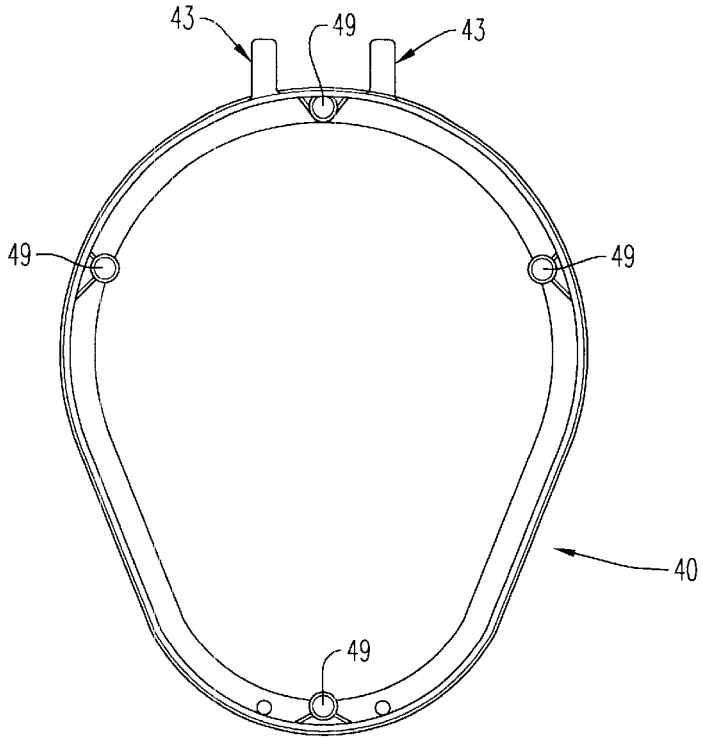
FIG. 6 is the top view of the bottom moulded member of the golf bag of FIG. 1.
Figure 7:
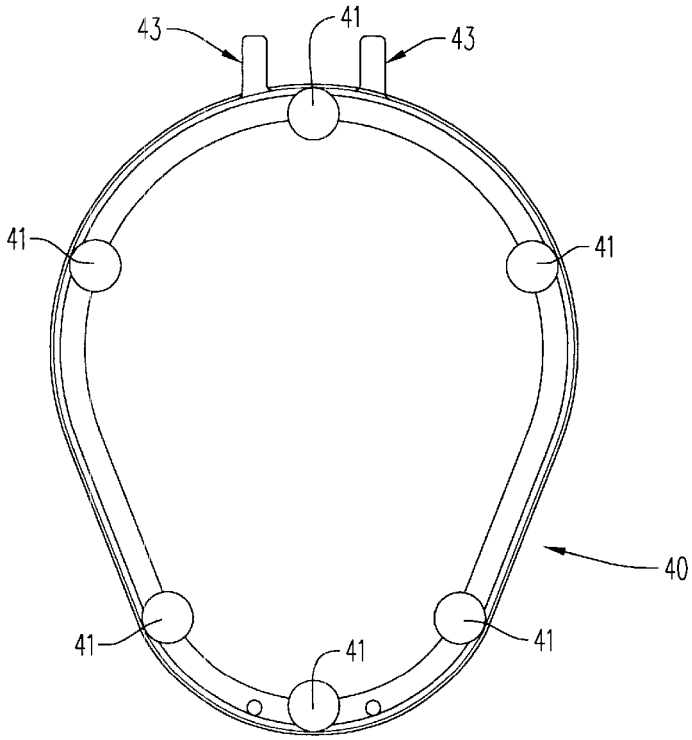
FIG. 7 is the bottom view of the bottom moulded member of FIG. 6.
Figure 8:
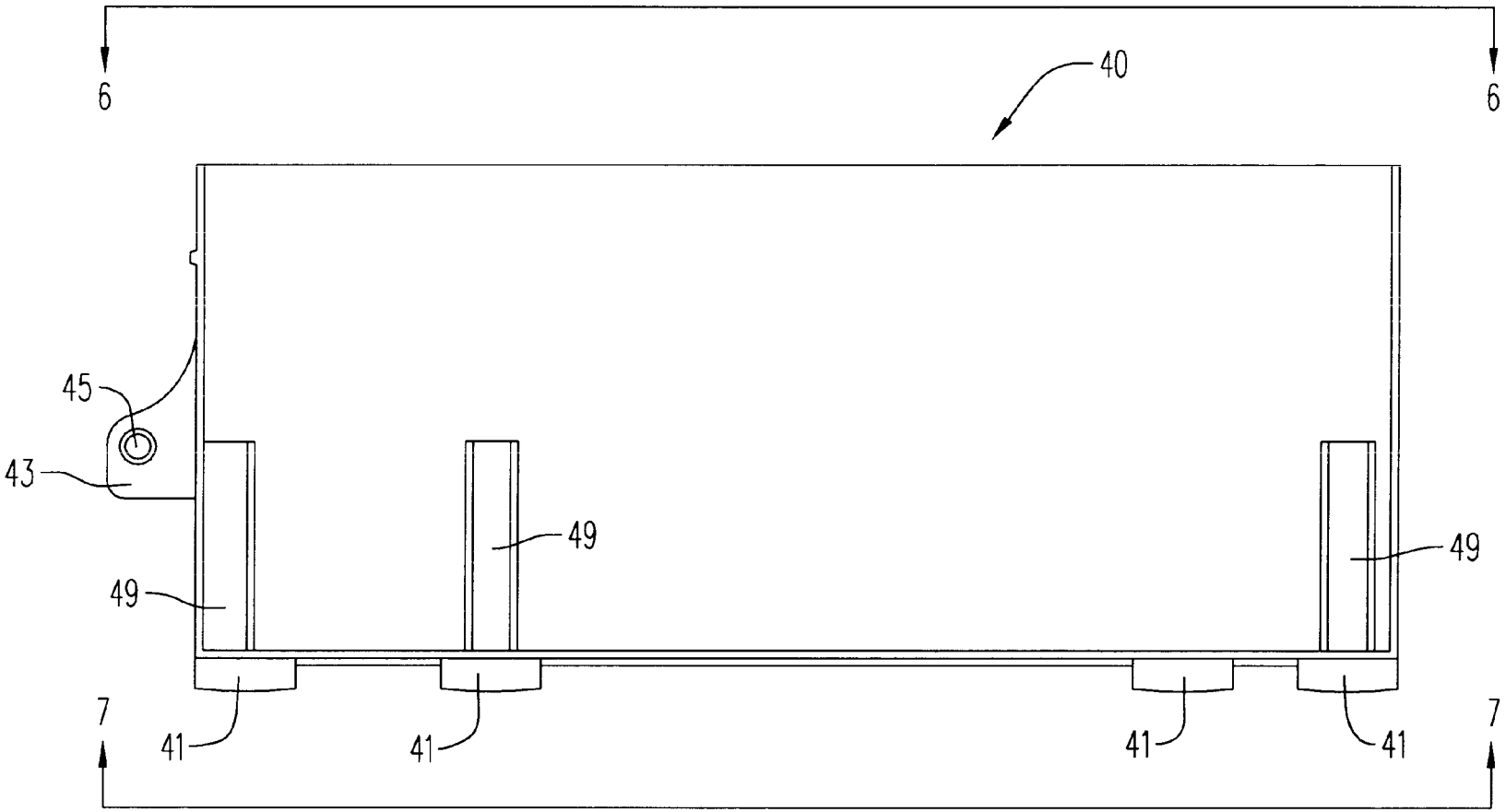
FIG. 8 is a cross-sectional view of the bottom moulded member of FIG. 6.
Figure 9:
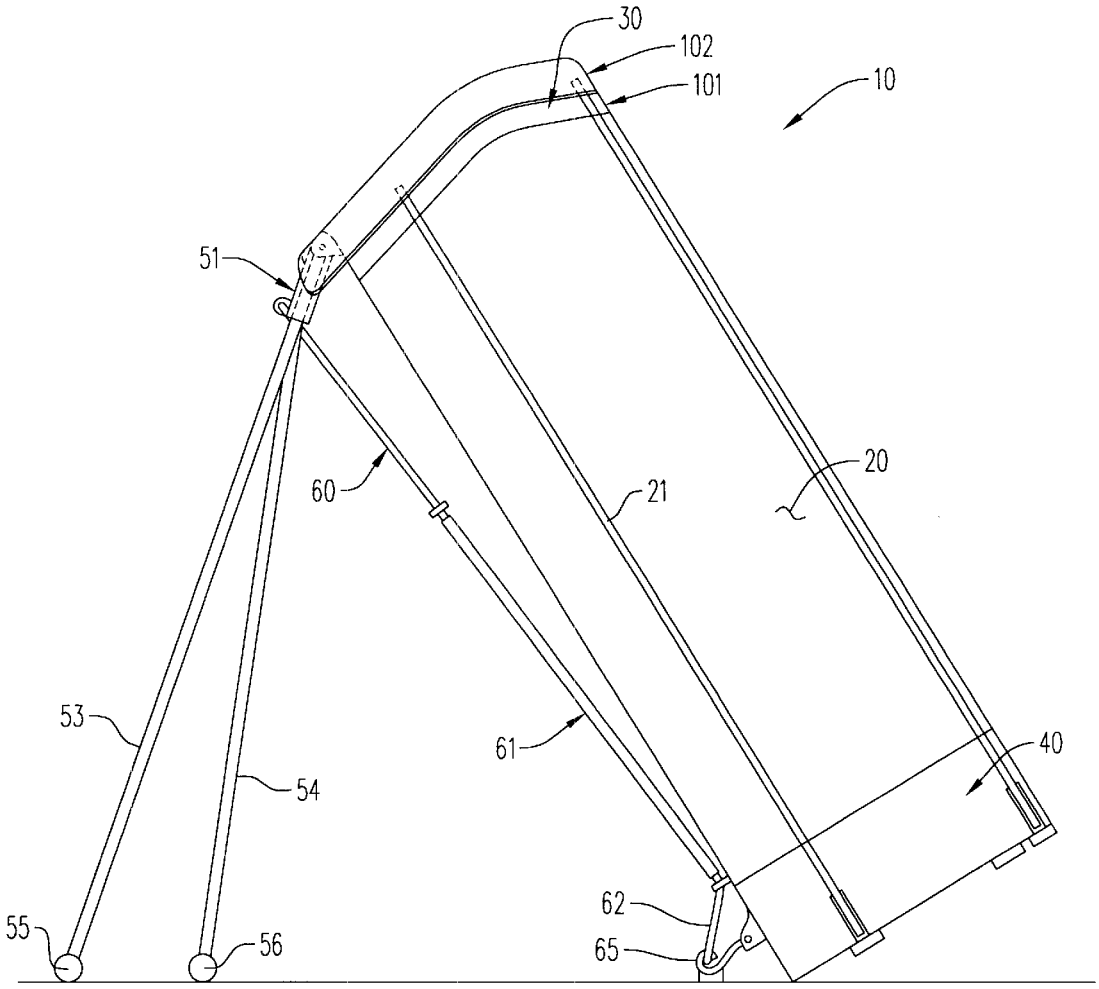
FIG. 9 is a side view of the golf bag of FIG. 1 with the stand assembly fully extended and resting on ground (symmetry not accurately shown)

As illustrated in FIGS. 6, 7, and 8, the bottom moulded member 40 includes a base portion and an integrally moulded circumferential wall extending longitudinally from the periphery of the base portion. The base portion is preferably made of a strong and hard plastic material as all the weight of the golf clubs carried in the golf bag are born by the base portion. To allow for a simple and easy attachment of the retraction mechanism of the stand assembly 50 to the golf bag, a bottom bracket 43 is preferably integrally moulded onto the outside of the circumferential wall. The bottom bracket 43 in this preferred embodiment is disposed so that when the top and bottom moulded members 30, 40 are properly assembled, the top and bottom brackets are aligned so that when the stand assembly is secured to the brackets, the stand assembly 50 is laterally symmetrical about the longitudinal axis of the golf bag.

As shown in FIG. 1, the stand assembly 50 includes a pair of legs 51, 52 and a retraction mechanism. The pair of legs 51, 52 are preferably laterally symmetrical to each other and are secured within the bracket channels 33 which are defined by the respective bracket walls by fastening means 34, 35. In the present embodiment, the bracket channels 33 are disposed at an angle to each other such that the channels move away from each other as they extend away from the circumferential wall of the neck portion. As the pivotal movements of the legs 51, 52 are guided and confined by the orientation of the bracket channels 33, the free ends of the legs 51, 52 spread to form a stable base as the free ends of the legs move pivotably away from the golf bag 10.

The retraction mechanism includes a bifurcated arm 61 which is attached to the top part of the legs 51, 52. Another end of the bifurcated arm 61 is connected to a linkage lever 62 which is in turn connected to a spring biased plank member 65. The plank member 65 is secured to the lower bracket 43 of the bottom moulded member 40 by a fastening means 45 which allows pivotal movement of the plank member 65 about the axis of the fastening means. The operation of the retractable legs is as follows. When the pair of legs 51, 52 move away from the golf bag 10, the bifurcated arms 61 are pulled upwards, thereby drawing the non-fastened end of the plank member 65 upward about the axis of the fastening means 45. This increases the spring bias at the plank member 65 which automatically retracts the bifurcated arms 61 when the force restraining the legs has been removed.

The supporting structure includes a plurality of stay members 21 which extend between the top and bottom moulded members. Each stay member 21 is typically a rigid and robust post supporting the top moulded member from the bottom moulded member. A plurality of longitudinal extending stay channels 49 adapted to receive the stay members 21 in a substantially upright direction are distributed on the base portion of the bottom moulded member 40 to distribute the weight transmitted from the top moulded member 30 through the stay members 21. A plurality of longitudinally extending stay channels 39 are formed on the underside of the top moulded member corresponding to the positions of the stay channels 49 on the bottom moulded member 40. In addition to providing accommodation to the stay members 21, the stay channels 39, 49 on both the top and bottom moulded members also serve as preformed positioning means for the relative alignment of the top and bottom brackets which are required to achieve and maintain a substantially lateral symmetry of the stand assembly. As the stay channels 39, 49 are preferably integrally moulded on the top and bottom moulded members, the high accuracy of present day moulding technology would have no difficulty in ensuring accurate and expedient relative alignments of the top and bottom brackets to ensure lateral symmetry of the stand assembly to enhance safety and durability without undue and tedious alignment procedures.

To complete the golf bag body, and as the golf body is not required to sustain any significant weight, an enclosure made preferably of a flexible material, such as leather, cloth or canvas can be used to wrap around the supporting structure. The top part of the enclosure is preferably attached to the wall 71 of the neck portion of the top moulded member and immediately abutting the lower side of the circumferential wall 73 of the collar portion for aesthetic considerations. Similarly, the lower part of the enclosure is preferably attached to the circumferential wall of the bottom moulded member 40.

In the ordinary use of a golf bag, golf clubs are placed inside a golf bag with handles resting on the bottom portion, heads protruding from the top moulded member and shafts resting against the inner edge of the partition structure of the top moulded member. The shafts of many expensive golf clubs are made of graphite and it is well known that graphite shafts are vulnerable to damage by agitation with hard plastic. To alleviate the potential damages which may result from such agitations, the top moulded member, which is usually made of a hard plastic material, is usually wrapped with a cushioning material such as foam, leather, velvet, cloth or a combination of suitable cushioning materials. In order that the cushioning member does not hinder or obstruct the pivotal movement of the stand assembly about the top bracket, part of the cushioning member proximate to the top bracket is either totally removed or left as a flap member. However, this is somewhat unsightly and affects the overall aesthetic appearance of the golf bag and may affect the popularity or market acceptance of a golf bag even if it offers superior technical benefits. This undesirable feature of a convention golf bag is somewhat alleviated in the preferred embodiment to be described below.

Figure 10:
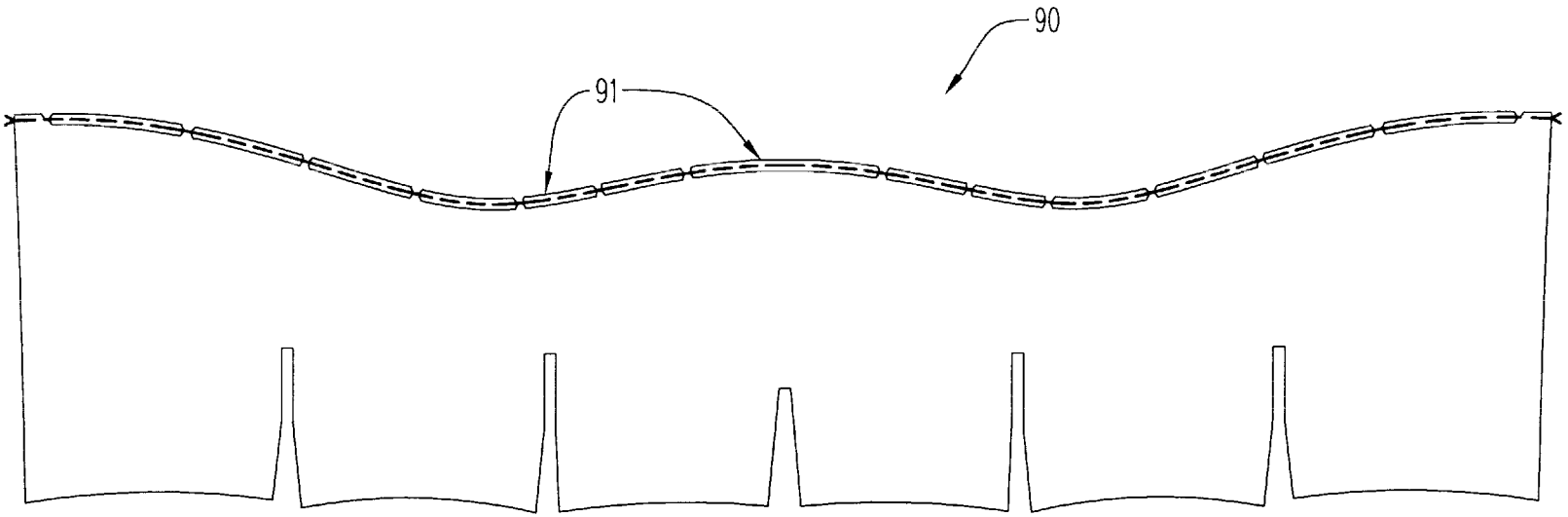
FIG. 10 shows a pattern of the cushioning material for wrapping the top moulded member of the present invention.
Figure 11:
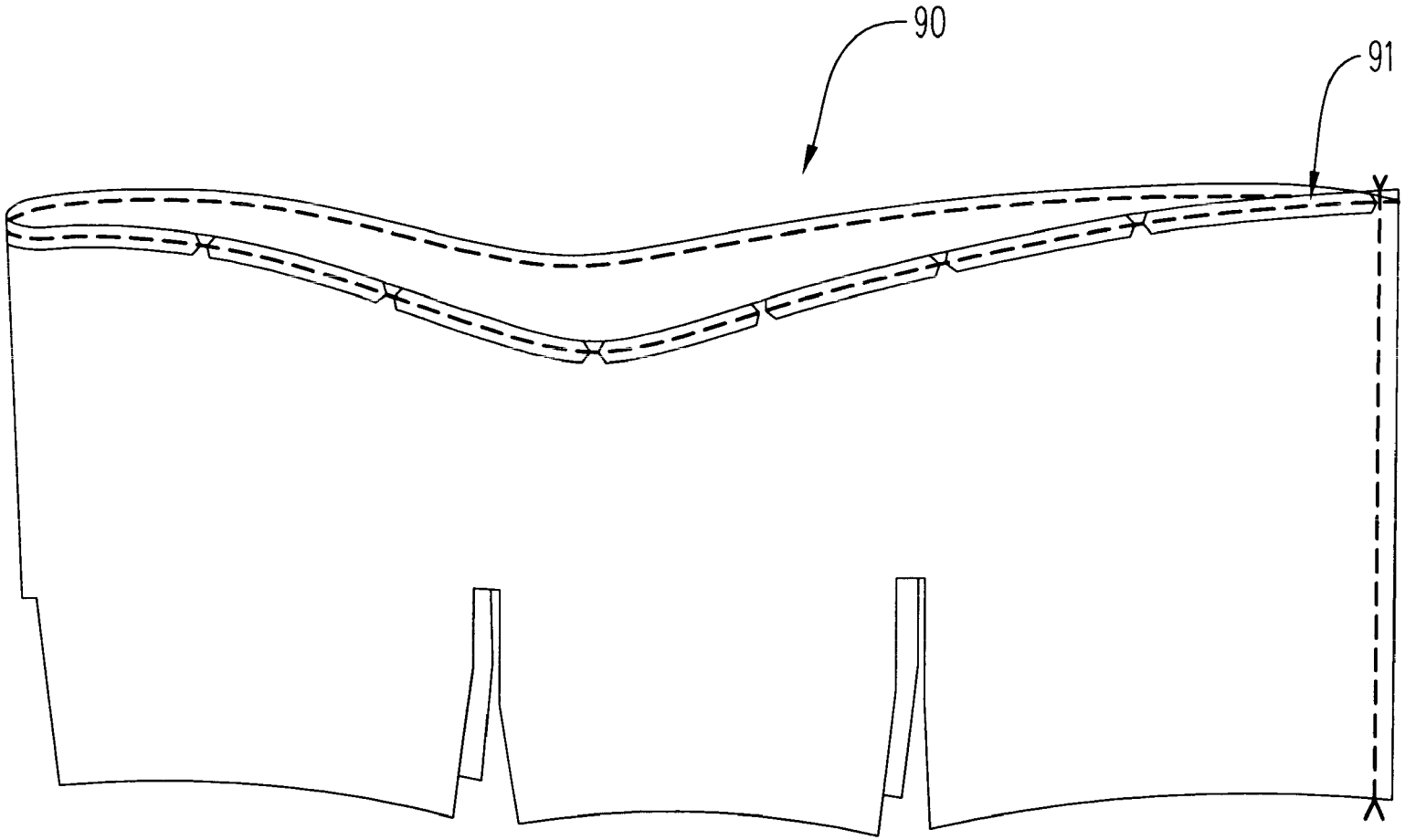
FIG. 11 is a side view of the cushioning member when sewn.

Referring more particularly to FIGS. 1–4 and the description above, the top moulded member 30 includes an inner neck portion 101 and an outer collar portion 102. When the golf bag has been completely enclosed by the body enclosure, the lower outer portion of the circumferential wall 71 of the neck portion 101 will be enclosed by the golf bag enclosure. Only the outside circumferential wall 73 of the collar portion 102 remains exposed on the outside of the golf bag 10. To provide cushioning for the top moulded member 30, a pattern of cushioning material following an appropriate shape and configuration as shown for example in FIG. 10 is first prepared. The cushioning member 90 is preferably made of a flexible material which is graphite friendly such as leather, cloth or velvet and preferably with a layer of foam or other soft materials. The upper edge of the cushioning member 90 is preferably reinforced by a semi-rigid beam 91 to make that portion of the cushioning member semi-rigid for the reasons below. When the ends of the cushioning member are sewn together, the top reinforced edge of the cushioning member 90 will generally follow the shape of the receiving channel 35 formed on the underside of the top moulded member 30. The lower portion of the cushioning member 90 is preferably provided with a plurality of slit openings 92 so that the flexible portion of the cushioning member 90 can be wrapped around the shoulder portion 32 and the partitioning structure.

Figure 4:
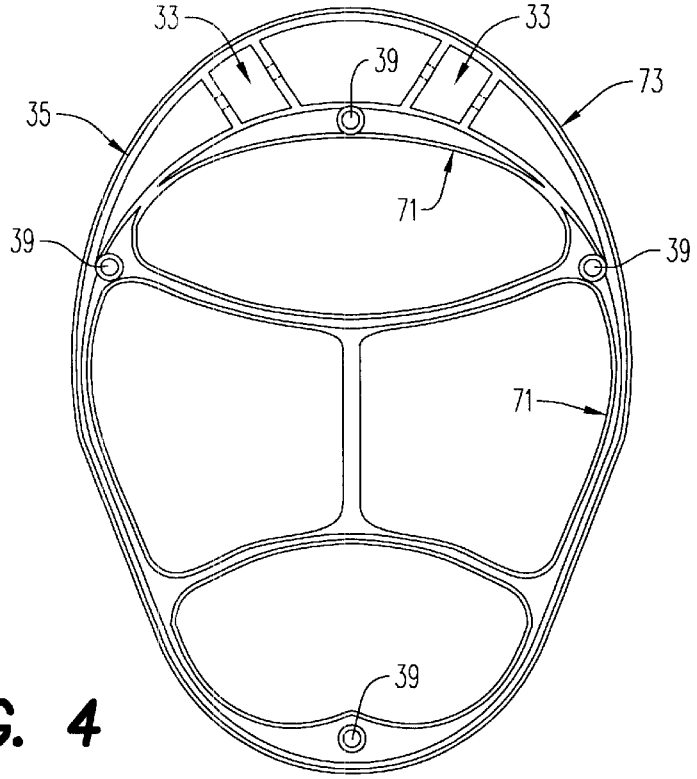
FIG. 4 is the bottom view of the top moulded member of FIG. 2.
Figure 5:
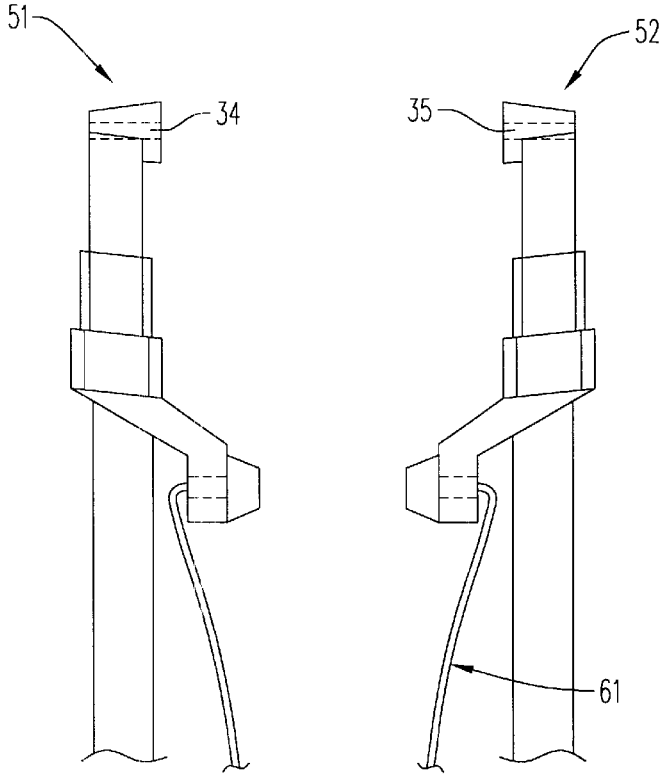
FIG. 5 is a side view of the legs of the stand assembly of the golf bag of FIG. 1.
Figure 12A:
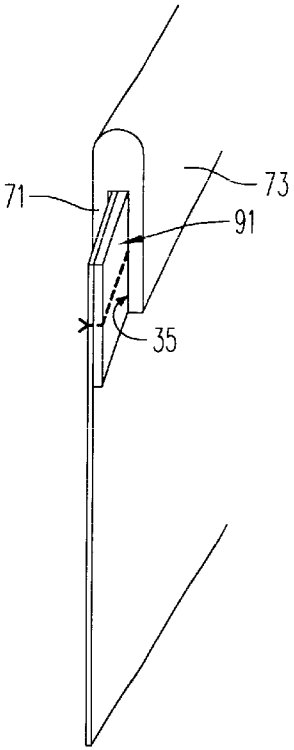
FIG. 12*a* is a perspective view of the partly cushioned top moulded member after the cushioning material of FIG. 11 has been inserted to the underside of the top moulded member of the golf bag.
Figure 12B:
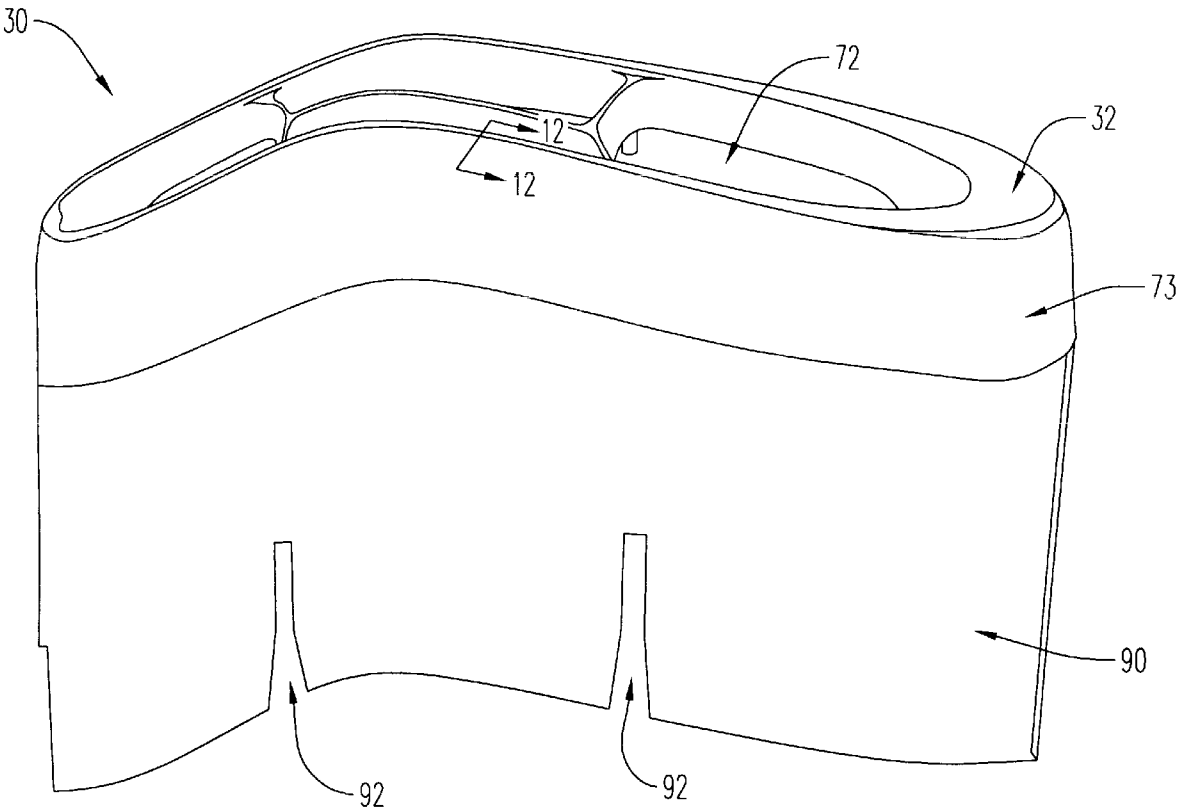
FIG. 12*b* is a cross sectional view of the collar member of FIG. 12*a* taken along lines 12—12 in FIG. 12*a;*
Figure 13A:
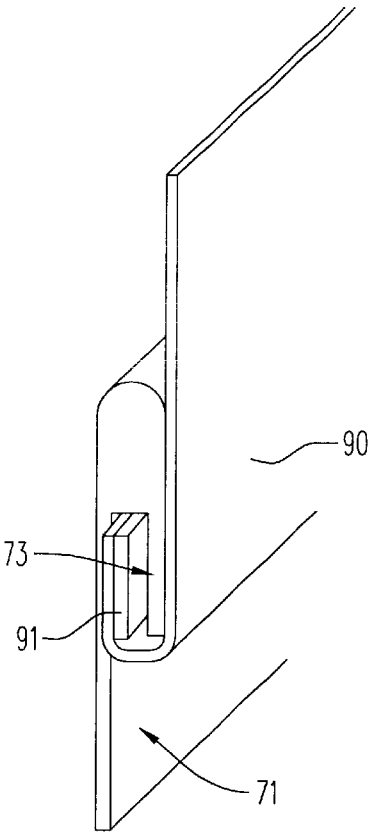
FIG. 13*a* shows the cushioning member after it has been inserted into the top moulded member and folded once.
Figure 13B:
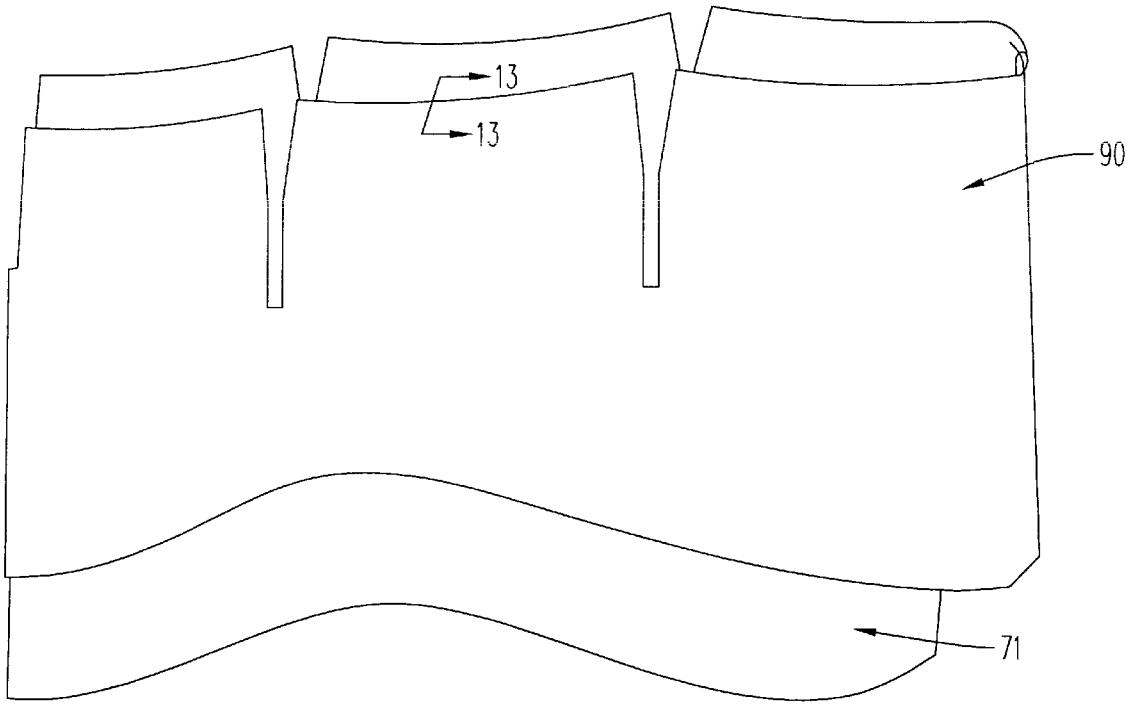
FIG. 13*b* is a cross sectional view of the cushioning member of FIG. 13*a* taken along lines 13—13 of FIG. 13*a;*

Referring now to FIG. 4, which is a view of the underside of the top moulded member 30, a circumferential channel 35 is formed along the inside of the lower end of the circumferential wall 73 of the collar portion. The width of the channel 35 is preferably about the same as that of the semi-rigid beam 91 of the cushioning member for good retention of the beam. The semi-rigid beam 91 on the cushioning member 90 is first inserted into the channel 35 as shown in FIG. 12*a*. Additional detail can be found in FIG. 12*b*, which is a perspective view of the top moulded member after the semi-rigid beam 91 has been inserted into the receiving channel 35. Once the upper reinforced portion 91 of the cushioning member 90 is received within the receiving channel 35, the remaining part of the cushioning member is bent upwards about the lower edge of the collar wall 73, as may be seen by reference to FIGS. 13*a* and 13*b*.

Figure 14A:
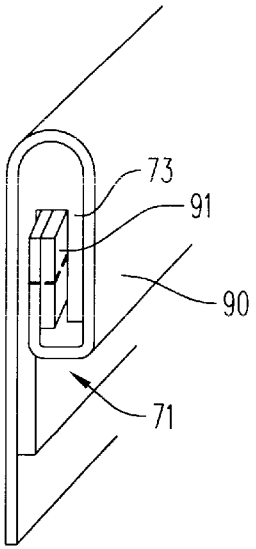
FIG. 14*a* shows the cushioning member of FIG. 13 after it has been folded twice.
Figure 14B:
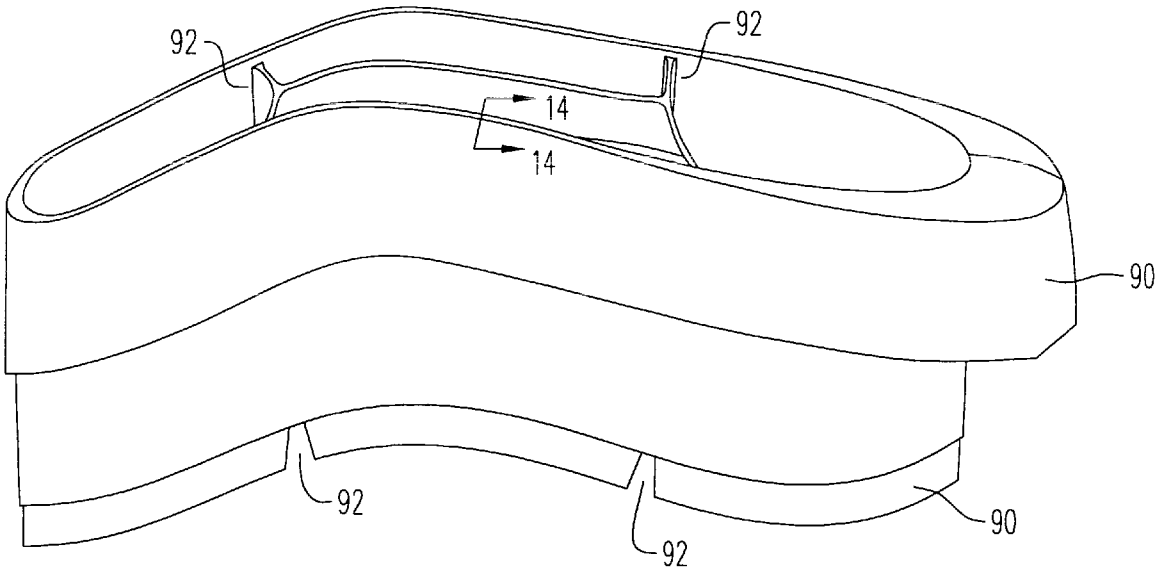
FIG. 14*b* is a cross sectional view of the cushioning member of FIG. 14*a* taken along lines 14—14 of FIG. 14*a;*
Figure 15A:
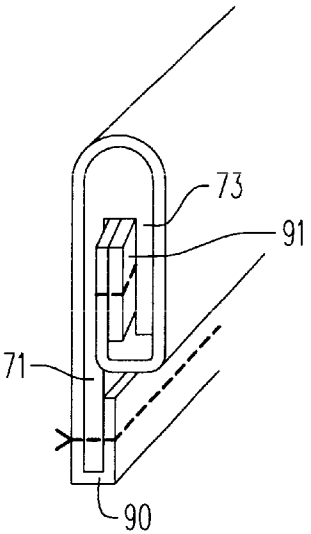
FIG. 15*a* shows the cushioning member after it has been folded three times and sewn onto the bottom of the neck portion of the top moulded portion.
Figure 15B:
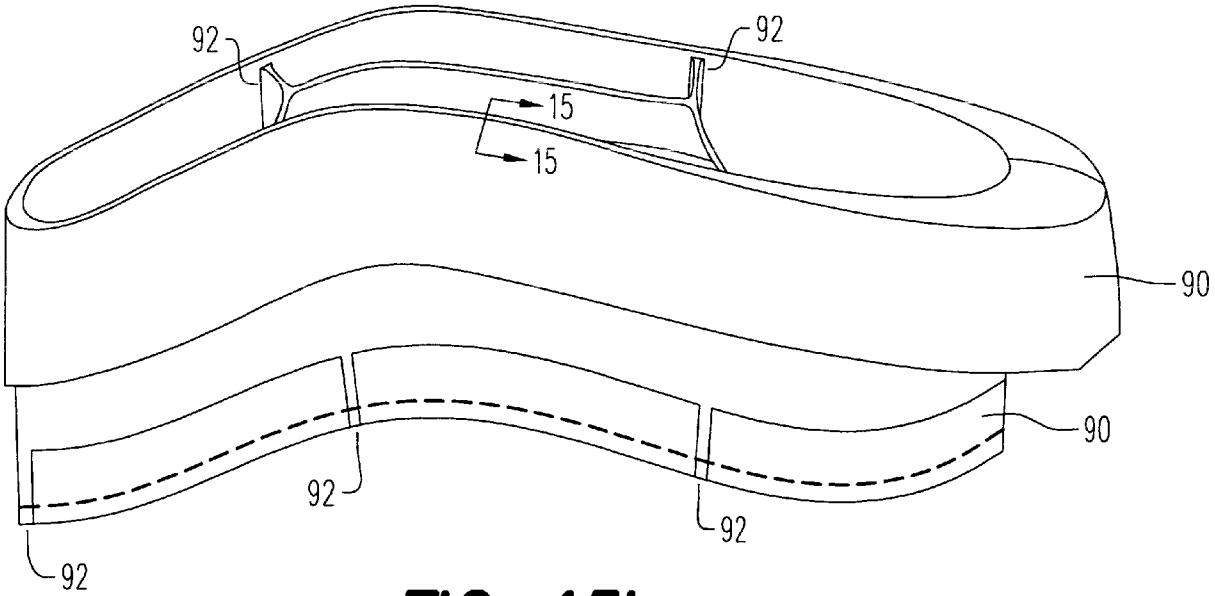

After the semi-rigid beam 91 has been received within the slot 35 and the remaining portion of the cushioning member 90 has been bent for about 180°, it will be substantially locked in place by the channel 35. As shown in FIGS. 14*a* and 14*b*, the cushioning member 90 is then bent again to pass over the shoulder portion 32 and then to bring the cushioning member inside the neck aperture. The slit openings 92 allow the cushioning member 90 to fit over the partioning structure within the neck aperture. Finally, the lower portion of the cushioning member 90 is bent once again and the lower-most portion will be secured onto the outside of the circumferential wall 71 of the neck portion which is below the collar portion. As the brackets 33 for receiving the stand assembly are formed within the space enclosed by the wall of the inner neck portion 71, the wall of the outer collar portion 73, and the shoulder portion 32, the brackets 33 are substantially concealed from the sight of an ordinary golfer in his or her ordinary standing position as the joints between this stand assembly and the top moulded member are substantially concealed by the collar and shoulder portion proximate to the bracket.

In addition to being more aesthetically pleasing, since the stand assembly joints are hidden under the top moulded member 30, the fastening means 34, 35 are also shielded from direct weathering for enhanced safety and durability. Furthermore, as the top portion of the cushioning member 90 is reinforced by a semi-rigid beam 91, the top part of the cushioning member 90 will be securely retained within the receiving channel 35 after the remaining portion of the cushioning member has been bent. With this arrangement, the cushioning member 90 can be secured to the top moulded member 30 with a single sewing as compared to multiple sewings required in the conventional way of attaching a cushioning member to the top member of a golf bag.

While the present invention has been explained by reference to an embodiment of a golf bag in which the top and bottom moulded members are provided with brackets which are integrally moulded, it should be appreciated by person skilled in the art that the bottom bracket does not usually subject to excessive force and may be replaced by a bracket which is not integrally moulded to the bottom moulded member without loss of generality. In addition, while the preferred embodiment is shown with a circumferential receiving channel for releasably securing the reinforced end of the cushioning member it should be appreciated that both ends of the cushioning members can be sewn onto the top moulded member without loss of generality and without affecting the scope of the present invention. Furthermore, while the present invention has been explained by reference to the preferred embodiments, it should be appreciated that the various features described above may be combined, isolated or rearranged with appropriate modifications or variations without affecting the scope of the invention.

What is claimed is:

1. A moulded top member of a golf bag including:

a neck portion, a collar portion, and a shoulder portion which are integrally moulded, said neck portion includes a longitudinally extending circumferential wall which defines the inner transversal aperture of said top member, said collar portion includes a longitudinal extending circumferential wall which generally defines the outer transversal extent of said top member and which surrounds said longitudinal extending wall of said neck portion, said shoulder portion includes a bridging member which interconnects the upper edges of said collar portion and said neck portion and maintaining a transversal space between said collar portion and said neck portion, said top moulded member further including:

a latching member for securing a part of a retractable stand assembly to said top member integrally formed across said collar portion and said neck portion and in the space underneath said shoulder portion, and a cushioning member having a first and a second end secured on said top member, wherein said first end is secured on said collar portion, said second end is secured on said neck portion, and a portion of the cushioning member extending between said first and second ends covers said shoulder portion.

2. A moulded top member according to claim 1, wherein one circumferential end of said cushioning member includes a semi-rigid portion.

3. A moulded top member according to claim 1, wherein means for releasably securing said cushioning member is integrally formed on the lower longitudinal edges of said collar portion and said neck portion of said moulded member.

4. A moulded top member according to claim 3 wherein said means for releasably securing one end of said cushioning member is formed intermediate between said collar member and said neck portion.

5. A moulded top member according to claim 3 wherein said means for securing said cushioning member includes a channel integrally formed between said neck and collar portion.

6. A moulded top member according to claim 1 wherein a latching member for receiving part of said stand assembly is integrally moulded on said top member between the circumferential walls of said neck and collar portions and underneath said shoulder portion.

7. A moulded top member according to claim 1 wherein said second end of said cushioning member is secured onto the outside of the circumferential wall of said neck portion which is not surrounded by said collar portion.

8. A golf bag comprising:

a top moulded member according to claim 1;

a closed moulded bottom member;

a supporting structure connecting said top and bottom moulded members;

an enclosure extending between the top and bottom moulded members and enclosing said supporting structure and a stand assembly.

9. A golf bag according to claim 8, wherein said second end of said cushioning member is secured onto the outside of the circumferential wall of said neck portion which is not surrounded by said collar portion.

10. A golf bag according to claim 8, wherein one circumferential end of said cushioning member includes a semi-rigid portion.

11. A golf bag according to claim 8, further comprising:

means for releasably securing said cushioning member is integrally formed on the lower longitudinal edges of said collar portion and said neck portion of said moulded member.

12. A golf bag according to claim 11, wherein said means for releasably securing one end of said cushioning member is formed intermediate between said collar member and said neck portion.

13. A golf bag according to claim 11, wherein said means for securing said cushioning member includes a channel integrally formed between said neck and collar portion.

14. A golf bag according to claim 8, wherein a latching member for receiving part of said stand assembly is integrally moulded on said top member between the circumferential walls of said neck and collar portions and underneath said shoulder portion.

15. A moulded top member according to claim 1, wherein the first end of the cushioning member is secured in a channel formed between the collar portion and the neck portion, and wherein the width of the channel is about the same as the width of the first end of the cushioning member.

16. A moulded top member according to claim 15, wherein the second end of the cushioning member is secured to a longitudinal wall of the neck portion.

17. A moulded top member according to claim 15, wherein the first end of the cushioning member comprises a reinforcing beam.

* * * * *